US005615435A

United States Patent [19]

Wells et al.

[11] Patent Number: 5,615,435

[45] Date of Patent: Apr. 1, 1997

[54] MATTRESS COVER SECUREMENT APPARATUS

[75] Inventors: Thomas J. Wells, Carthage; Robert C. Starr, IV, Granby, both of Mo.

[73] Assignee: L & P Property Management Company, Chicago, Ill.

[21] Appl. No.: 567,842

[22] Filed: Dec. 6, 1995

[51] Int. Cl.[6] ..... A47C 27/045; A47C 31/02

[52] U.S. Cl. ..... 5/716; 5/410; 5/259.1

[58] Field of Search ..... 5/716, 717, 718, 5/737, 259.1, 409, 410

[56] References Cited

U.S. PATENT DOCUMENTS

| | | | |
|---|---|---|---|
| 1,182,276 | 5/1916 | Jacobs et al. | 5/410 |
| 2,107,446 | 2/1938 | Koliba | 5/410 |
| 2,766,816 | 10/1956 | Koenigsberg | 5/410 |
| 4,724,590 | 2/1988 | Langas et al. | 29/91 |
| 5,314,064 | 5/1994 | Wells et al. | 206/340 |

FOREIGN PATENT DOCUMENTS 2201341 9/1988 United Kingdom .

*Primary Examiner*—Alexander Grosz
*Attorney, Agent, or Firm*—Wood, Herron & Evans, P.L.L.

[57] ABSTRACT

An apparatus and method for securing a top panel cover of a mattress to an innerspring core include a plurality of clips attached to an upper border wire of the core. Each clip has one or more barbs that project inwardly with respect to the core. The cover is attached to the core by stretching and wrapping the edges of the cover over and around the border wire and pushing the edges against the barbs so that the barbs pierce the edges and hold the edges in a taut position at least partially wrapped around the border wire.

10 Claims, 2 Drawing Sheets

MATTRESS COVER SECUREMENT APPARATUS

FIELD OF THE INVENTION

This invention relates to bedding products. More particularly, this invention relates to the attachment of a top panel cover to an innerspring core of a mattress or boxspring.

BACKGROUND OF THE INVENTION

Typically, a mattress is composed of a spring assembly or innerspring core covered by a fabric or textile covering. The innerspring core usually has a plurality of coil springs arranged in rows between upper and lower border wires, with the endmost coil springs in each row being joined to the upper and lower border wires by means of sheet metal clips. The top panel of the mattress cover is then affixed to the upper border wire by wrapping the edges of the cover around the upper border wire and then securing the edges in position by means of stitching, gluing, or securing with staples or hog rings.

These conventional methods of securing the top mattress cover to the innerspring core are generally manual operations. Consequently, a significant degree of nonuniformity in the end product inevitably results. Furthermore, these largely manual methods entail significant substantial labor as well as material costs.

It has therefore been an object of the present invention to provide an apparatus and method of attaching top mattress covers to innerspring cores so as to facilitate automation or at least reduction in the manual labor of the process, thereby reducing the cost and nonuniformity in the end product.

It has been a further object of the present invention to provide an apparatus and method for attaching mattress covers to innerspring cores so as to eliminate the need for hog rings or glue and thereby reduce the material costs incurred.

SUMMARY OF THE INVENTION

These and other objects of the invention are achieved by an improved means of securing a mattress cover to an innerspring core. A mattress incorporating the present invention includes an innerspring core having generally planar top and bottom surfaces, a border wire surrounding the top surface, a mattress cover located atop the top surface, and a plurality of clips attached to the border wire. Each of the clips has a barb that in an open position projects generally inwardly with respect to the mattress core and away from the border wire. The mattress cover is secured to the border wire by stretching and wrapping the edges of the mattress cover over and around the border wire, then hooking the edges of the mattress cover onto the barbs of the clips so that the barbs at least partially pierce the mattress cover and hold the edges of the mattress cover in a taut position at least partially wrapped around the border wire. The barbs may be left in open position, or they may be bent, after attachment of the edge of the cover, into a closed position such that the edge is sandwiched between the barbs and the border wire.

The clips may be stamped out of sheet metal with the barbs being integrally formed portions of the clips. These sheet metal type clips are attached to the border wire by bending the clips around the border wire and clamping them onto the border wire.

Alternatively, the clips may be made of lengths of wire bent to clip onto the border wire, with one or both ends of each length of wire shaped so as to project generally inwardly and away from the border wire, the ends thereby serving as the barbs to which the edges of the cover are attached.

The sheet metal type of clip may serve both to secure a coil spring to the border wire and to provide one or more barbs to which an edge of the cover is attached. Alternatively, some or all of the sheet metal clips may serve solely to provide barbs for attachment of the cover to the border wire without serving to secure the coil springs to the border wire. A combination of sheet metal type and wire type clips may be used.

A sheet metal clip according to the present invention comprises a generally U-shaped member having an arcuate crown portion and spaced generally parallel leg portions depending from the crown portion. In one embodiment of the clip, the leg portions include a single-prong portion and an opposing dual-prong portion. When the clip is clamped around a border wire, the single-prong portion fits between dual prongs of the opposing dual-prong portion. One prong of the dual-prong portion is left unclamped and thereby serves as a barb for attachment of a top cover.

In an alternative embodiment of a sheet metal clip, the leg portions include a single-prong portion and an opposing triple-prong portion. When the clip is clamped around a border wire, the single-prong portion fits between two adjacent prongs of the opposing triple-prong portion. One prong of the triple-prong portion is left unclamped and thereby serves as a barb for attachment of a top cover.

With either embodiment of the sheet metal clip, once the edge of the top cover has been attached to the barb, the barb is preferably clamped down onto the border wire to aid in keeping the edge secured in a taut position at least partially wrapped around the border wire. Similarly, the barbs of the wire type of clip preferably are bent down onto the border wire after attachment of the edge of the top cover.

BRIEF DESCRIPTION OF THE DRAWINGS

The objects, features, and advantages of the present invention will be better understood by reference to the following detailed description of the preferred embodiments taken in conjunction with the accompanying drawings, in which.

DESCRIPTION OF THE PREFERRED EMBODIMENTS

Figure 1:
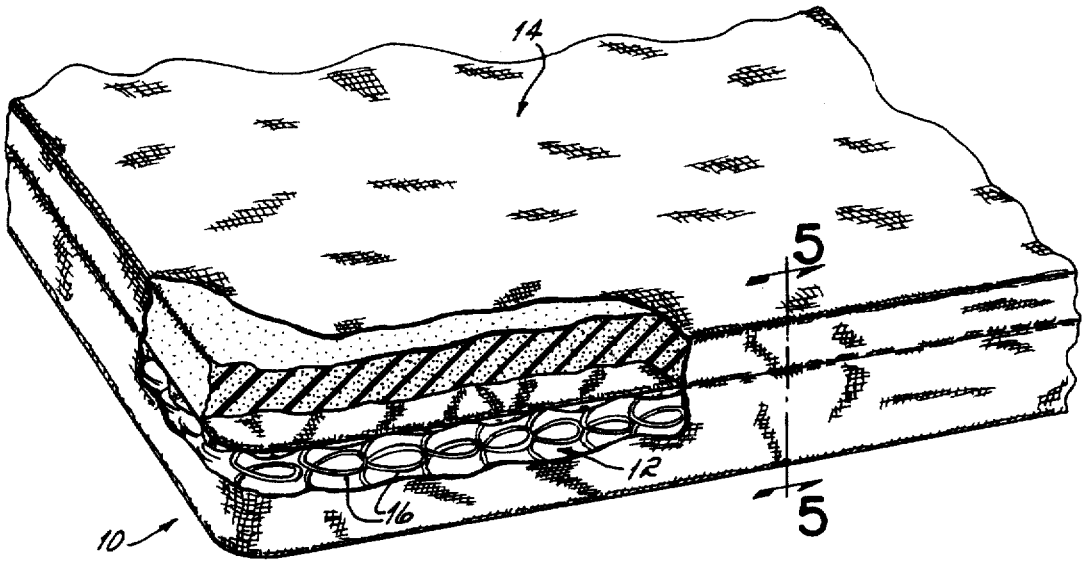
FIG. 1 is a partially cut-away perspective view of a mattress showing the internal construction of the mattress core.

As shown in FIG. 1, a mattress 10 includes a top cover 14, and an innerspring core 12 having a plurality of rows of coil springs 16.

Figure 4:
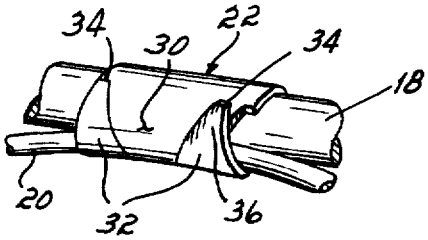
FIG. 4 is a partial perspective view of a dual-prong sheet metal clip attached to a border wire and coil spring, showing one of the prongs of the dual-prong leg portion left in an open, unclamped position so as to serve as a barb.
Figure 5:
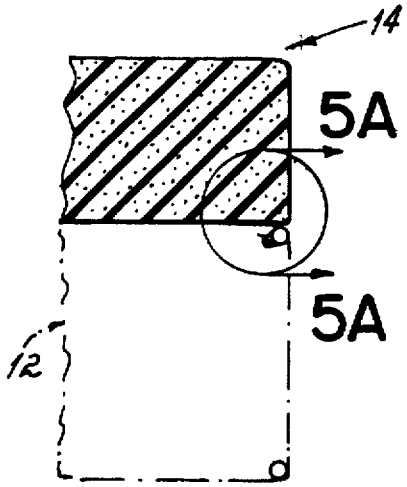
FIG. 5 is a cross-sectional view taken along the line 5—5 of FIG. 1, showing a top cover attached to an innerspring core of a mattress.

With reference to FIG. 5, the innerspring core 12 includes an upper border wire 18. In each row of coil springs 16, the endmost coil spring 16 has an uppermost coil revolution 20 attached to the upper border wire 18 by means of a sheet metal clip 22, as shown in FIG. 4.

Figure 2:
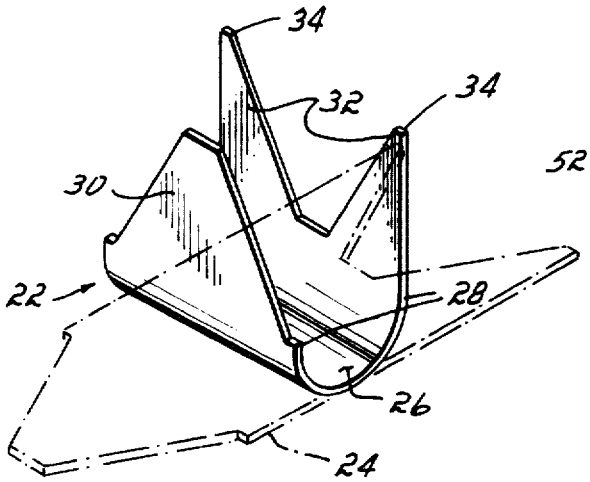
FIG. 2 is a perspective view of a sheet metal clip having single-prong and dual-prong leg portions, also showing the sheet metal blank from which the clip is formed.

With reference to FIG. 2, one embodiment of a sheet metal clip 22 is shown. The sheet metal clip 22 is formed from a blank 24 that is stamped from sheet metal stock. The clip 22 has an arcuate crown portion 26 and leg portions 28 depending from the crown portion 26. The leg portions 28 include a single-prong leg portion 30 and an opposing dual-prong leg portion 32 having prongs 34.

As shown in FIG. 4, when the clip 22 is attached to an upper border wire 18 and an uppermost coil revolution 20, the single-prong portion 30 fits between the prongs 34 of the dual-prong portion 32. One prong 34 is left in an unclamped, open position in order to serve as a barb 36.

Figure 3:
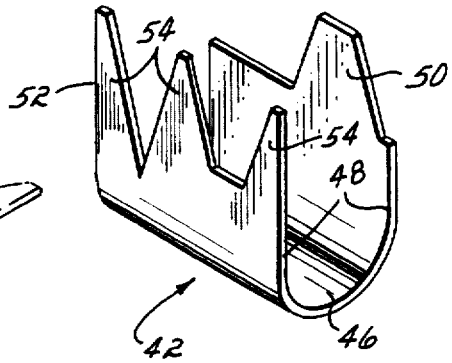
FIG. 3 is a perspective view of a sheet metal clip having single-prong and triple-prong leg portions.

With reference to FIG. 3, an alternative embodiment of a sheet metal clip 42 is shown. The sheet metal clip 42 has an arcuate crown portion 46 and leg portions 48 depending from the crown portion 46. The leg portions 48 include a single-prong portion 50 and an opposing triple-prong portion 52 having prongs 54. One of the prongs 54 is left in an unclamped, open position when the clip 42 is attached to an upper border wire, the open prong thereby serving as a barb.

Figure 5A:
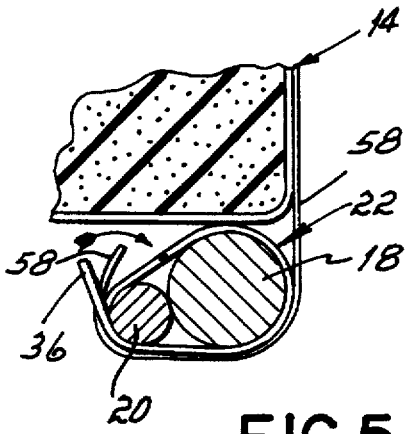
FIG. 5A is an enlarged cross-sectional view showing an edge of a top cover partially wrapped around a border wire and a barb on a sheet metal clip piercing the edge and holding the edge in a taut, partially wrapped position.

With reference to FIG. 5A, the top cover 14 has affixed to it an edge 58. As shown, the top cover 14 is located atop the innerspring core 12 with the edge 58 generally aligned with the upper border wire 18. Each uppermost coil revolution 20 of endmost coil springs 16 is joined to the upper border wire 18 by a sheet metal clip 22 having a barb 36 that in open position, as shown, projects generally inwardly and away from the upper border wire 18. The edge 58 of the top cover 14 is attached to the innerspring core 12 by stretching the edge 58 and wrapping the edge 58 at least partially around the upper border wire 18 and then pushing the edge 58 against each barb 36 so that the barb 36 pierces the edge 58 as shown. The barb 36 acts to hold the edge 58 in a taut position at least partially wrapped around the upper border wire 18. As indicated by the arrow in FIG. 5A, the barb 36 may then be closed by bending it toward the upper border wire 18 so as to sandwich the edge 58 between the barb 36 and the border wire 18 and thereby further aid in holding the edge 58 in place.

Figure 6:
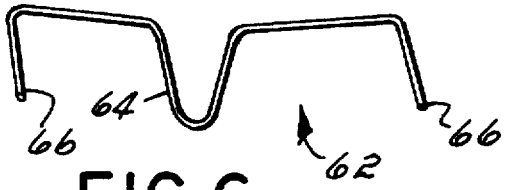
FIG. 6 is a perspective view of a wire clip.
Figure 8:
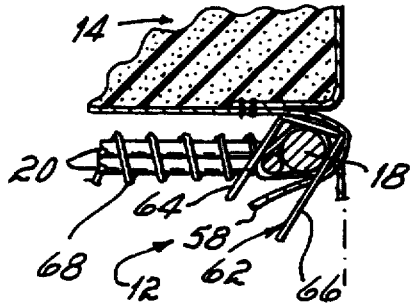
FIG. 8 is a cross-sectional view taken on line 8—8 of FIG. 7 showing an edge of a top cover partially wrapped around a border wire and a barb on a wire clip piercing the edge and holding the edge in a taut, partially wrapped position.

With reference to FIG. 6, an alternative embodiment of a clip 62 is shown. The clip 62 is formed from a length of wire so as to clip onto the upper border wire 18 as shown in FIG. 8. The clip 62 has barbs 66 shaped so as to project generally inwardly and away from the upper border wire 18 when the barbs 66 are in a open position as shown in FIGS. 7 and 8.

As shown in FIG. 8, the barbs 66 pierce the edge 58 of the top cover 14 and hold the edge 58 in a taut position at least partially wrapped around the upper border wire 18. The barbs 66 may be bent into a closed position if desired.

Figure 7:
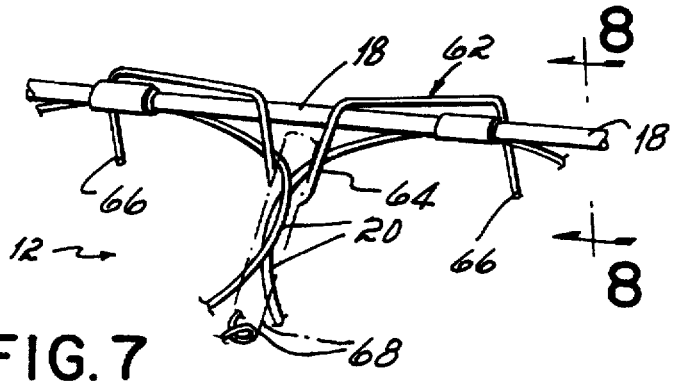
FIG. 7 is a partial perspective view of a wire clip attached to a border wire, showing the ends of the wire clip in open positions and showing the wire clip engaging the coil springs and helical lacing wire.

As shown in FIGS. 7 and 8, the wire clip 62 has a middle portion 64 shaped so as to engage one or more uppermost coil revolutions 20 and/or a helical lacing wire 68 and thereby prevent the clip 62 from sliding along or rotating about the upper border wire 18.

A mattress cover is attached to an innerspring core in accordance with the present invention by first attaching a plurality of clips to an upper border wire of the innerspring core, the clips each having at least one barb that in an open position projects generally inwardly and away from the border wire. A mattress cover is then placed atop the innerspring core with the edges of the cover generally aligned with the upper border wire. The edges of the cover are then stretched downwardly so that they extend down beyond the border wire and are in tension, and while the edges are kept in tension they are wrapped around the border wire and are then pushed against the barbs of the clips such that the barbs at least partially pierce the edges and hold the edges in a taut position at least partially wrapped around the border wire.

It will be appreciated that the present invention thus provides a unique and cost-effective means of securing a top cover of a mattress to an innerspring core. From the above disclosure of the general principles of the invention and the description of the preferred embodiments, those skilled in the art will readily comprehend the various modifications to which the present invention is susceptible. Therefore, we desire to be limited only by the scope of the following claims and equivalents thereof.

We claim:

1. A mattress comprising an innerspring core having a generally planar top surface and a generally planar bottom surface and a plurality of coil springs therebetween, said coil springs each having generally circular top and bottom turns of fixed diameters, a border wire surrounding said top surface, a mattress cover located atop said top surface, and a plurality of clips attached to said border wire, said clips having at least one barb, each of said clips having a width substantially less than the diameter of said coil springs, said mattress cover having an edge stretched over and wrapped around said border wire, each said barb at least partially piercing said edge of said mattress cover so that said edge is maintained in a taut position at least partially wrapped around said border wire.

2. The mattress of claim 1 wherein each of said clips is formed of sheet metal and is attached to said border wire by bending said clip around said border wire and clamping said clip onto said border wire, said barb being an integrally formed portion of said clip.

3. The mattress of claim 1 wherein each of said clips comprises a generally U-shaped member having an arcuate crown portion and spaced generally parallel leg portions depending from said crown portion, said leg portions comprising a single-prong portion and an opposing dual-prong portion, said clip being clamped onto said border wire by bending said single-prong portion and a first prong of said dual-prong portion around said border wire, said barb comprising a second prong of said dual-prong portion.

4. The mattress of claim 1 wherein each of said clips comprises a generally U-shaped member having an arcuate crown portion and spaced generally parallel leg portions depending from said crown portion, said leg portions comprising a single-prong portion and an opposing triple-prong portion, said clip being clamped onto said border wire by bending said single-prong portion and first and second prongs of said triple-prong portion around said border wire, said barb comprising a third prong of said triple-prong portion.

5. The mattress of claim 1 wherein each of said clips has a width substantially less than half the diameter of said coil springs.

6. A mattress comprising an innerspring core having a generally planar top surface and a generally planar bottom surface, a border wire surrounding said top surface, a mattress cover located atop said top surface, and a plurality of clips attached to said border wire, said clips each having at least one barb, each of said clips being formed of a length of wire, said barb being an end portion of said length of wire bent so as to project generally inwardly and away from said border wire.

7. A mattress comprising a spring assembly and a top mattress cover, said spring assembly including lower and upper border wires each having a substantially rectangular shape with two sides and two ends, said upper and lower border wires being parallel each other, a plurality of rows of vertically oriented coil springs disposed between said sides of said lower and upper border wires, each of said coil springs having lowermost coil revolution coplanar with said lower border wire and an uppermost coil revolution coplanar with said upper border wire, endmost coil springs of said rows being located adjacent said lower and upper border wires and having the lowermost coil revolution joined to said lower border wire by a first clip and the uppermost coil revolution joined to said upper border wire by a second clip, said second clip having at least one barb projecting generally inwardly and away from said upper border wire, said top mattress cover having a substantailly rectangular shape with two end edges and two side edges, said end and side edges being stretched over and wrapped around corresponding said ends and sides of said upper border wire, said barbs at least partially piercing said end and side edges of said mattress cover so that said end and side edges are maintained in a taut position at least partially wrapped around corresponding said ends and sides of said upper border wire.

8. The mattress of claim 7 wherein said second clip is formed of sheet metal and is attached to said upper border wire by bending said sheet metal clip around said upper border wire and said coil spring and clamping said sheet metal clip onto said upper border wire and said coil spring, said barb being an integrally formed portion of said sheet metal clip.

9. The mattress of claim 7 wherein each of said second clips comprises a generally U-shaped member having an arcuate crown portion and spaced generally parallel leg portions depending from said crown portion, said leg portions comprising a single-prong portion and an opposing dual-prong portion, said clip being clamped onto said upper border wire and said coil spring by bending said single-prong portion and a first prong of said dual-prong portion around said border wire and said coil spring, said barb comprising a second prong of said dual-prong portion.

10. The mattress of claim 7 wherein each of said second clips comprises a generally U-shaped member having an arcuate crown portion and spaced generally parallel leg portions depending from said crown portion, said leg portions comprising a single-prong portion and an opposing triple-prong portion, said clip being clamped onto said upper border wire and said coil spring by bending said single-prong portion and first and second prongs of said triple-prong portion around said border wire and said coil spring, said barb comprising a third prong of said triple-prong portion.

* * * * *

UNITED STATES PATENT AND TRADEMARK OFFICE

CERTIFICATE OF CORRECTION

PATENT NO. : 5,615,435

DATED : April 1, 1997

INVENTOR(S) : Thomas J. Wells and Robert C. Starr, IV

It is certified that error appears in the above-indentified patent and that said Letters Patent is hereby corrected as shown below:

Column 5, line 25, "having lowermost" should be --having a lowermost--.

Signed and Sealed this

Nineteenth Day of August, 1997

*Attest:*

*Attesting Officer*

BRUCE LEHMAN

*Commissioner of Patents and Trademarks*